United States Patent [19]

Foulart

[11] Patent Number: 4,588,126

[45] Date of Patent: May 13, 1986

[54] METAL ELEMENT FOR FASTENING A RAIL TO A CONCRETE TIE

[75] Inventor: René J. Foulart, La Louviere, Belgium

[73] Assignee: Fagrobel S.A., La Louviere, Belgium

[21] Appl. No.: 615,457

[22] Filed: May 30, 1984

[30] Foreign Application Priority Data

| | | | |
|---|---|---|---|
| May 31, 1983 | [BE] | Belgium | 210881 |
| Sep. 21, 1983 | [EP] | European Pat. Off. | 83870094.6 |
| May 24, 1984 | [BE] | Belgium | 213004 |

[51] Int. Cl.[4] ..... E01B 9/30

[52] U.S. Cl. ..... 238/310; 238/349; 249/86

[58] Field of Search ..... 238/83, 84, 85, 91, 238/310, 338, 349, 351; 249/86

[56] References Cited

U.S. PATENT DOCUMENTS

| | | | |
|---|---|---|---|
| 3,326,466 | 6/1967 | Sanson | 238/349 |

FOREIGN PATENT DOCUMENTS

| | | | |
|---|---|---|---|
| 901782 | 1/1954 | Fed. Rep. of Germany | 238/310 |
| 654348 | 4/1929 | France | 238/338 |
| 2505379 | 11/1982 | France | 238/85 |
| 1585599 | 3/1981 | United Kingdom | 238/349 |

*Primary Examiner*—Randolph A. Reese

*Attorney, Agent, or Firm*—Abelman Frayne Rezac & Schwab

[57] ABSTRACT

A metal element for securing rails to cast concrete railroad ties by use of Pandrol clips includes a transverse plate extending between lugs of the metal element, and which prevents concrete admixture from filling a socket provided within the metal elements for the reception of a leg of the Pandrol clip.

6 Claims, 10 Drawing Figures

METAL ELEMENT FOR FASTENING A RAIL TO A CONCRETE TIE

FIELD OF THE INVENTION

This invention relates to an improved metal element to be incorporated into a concrete railroad tie during the pouring of the concrete tie, and which subsequently is to be employed in conjunction with a so-called "Pandrol" clip to secure the base or foot of a metal rail to the concrete tie.

BACKGROUND OF THE INVENTION

Metal elements for this use are well known in the art, such elements commonly being elongate and of inverted substantially U-shaped cross-section. The metal elements provide a curved portion positioned above the concrete tie and in which a lug of the clip is received, and two substantially parallel vertical sides terminating in downwardly extending anchoring lugs.

The anchoring lugs are embedded in the concrete tie during the pouring thereof to secure the metal element relative thereto, with the sides of the metal element positioned for engagement with a rail in substantially parallel relationship therewith. One of the vertical sides provides an abutment for the foot of the rail, the curved portion providing an anchor positioned above the tie, and which is for the reception of the securing clip.

Commonly, the curved portion includes a convex portion within which the lug of the clip is received, and an adjacent concave portion which provides a seating for another lug of the clip, the clip being of substantially circular cross-section throughout its length.

During the pouring of the concrete tie, it is necessary that concrete be prevented from entering the interior of the curved portion of the metal portion of the metal element, as this would prevent subsequent insertion of the lug of the clip. To prevent concrete from entering the curved portion, it is usual to provide a closure for the curved portion, comprised of moldings of plastics material. These are retained in the metal element by means of notches provided in the anchoring lugs, or, the closures are joined to each other by an interfitting stud and socket arrangement.

This arrnagement has several drawbacks, among which are the requirement to assemble the closure onto the metal element at the work site, and, the possiblity of damage to the relatively fragile end closures in the handling of the relatively heavy metal element, and, the possibility of displacement during the pouring of the concrete. Also, the closures are somewhat difficult to position accurately, and are relatively easily damaged during the pouring of the concrete. Futher, the respective parts are supplied by separate manufacturers, this increasing warehousing and handling costs, and, the overall cost of the on site assembly.

SUMMARY OF THE INVENTION

Objects of this invention are to provide metal elements which obviate the above-mentioned diadvantages of the known structures, and, which in addition permit the accurate positioning of the metal elements within the molds used in the casting of the ties, and minimize the possibility of movement of the metal elements within the molds during the pouring of the concrete.

Additionally, objects of this invention are to provide metal elements that are structurally stronger and dimensionally more accurate than known elements, and which eliminate assembly operations in readiness for the casting operation.

According to the present invention, the metal elements are provided with a rectangular metal plate which extends transversely between the sides of the metal elements and substantially parallel to the said curved portion, the plate being spaced from the curved portion by a distance sufficient to permit the said lug of the clip to be entered between the curved portion and the metal plate, the metal plate extending continuously between the end faces of the metal elements. Preferably, the metal plate extends substantially perpendicular to the respective sides of the metal elements.

According to another embodiment of the present invention, the metal plate extends beyond the end faces of the metal elements, preferably to equal extent beyond each of the end faces.

According to another embodiment of the present invention, two substantially C-shaped metal parts are attached to the exterior of the metal element in substantial parallelism with the said metal plate, and are attached at their ends to outwardly extending ends of the metal plate.

DESCRIPTION OF THE DRAWINGS

The invention will now be described with reference to the accompanying drawings, which illustrate preferred emobodiments of the invention, and in which.

DESCRIPTION OF THE PREFERRED EMBODIMENTS

Figure 1:
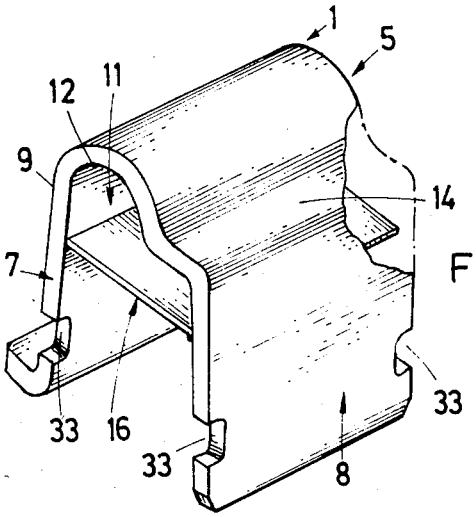
FIGS. 1 to 5 are perspective views, some with portions broken away to reveal inner detail, of five different embodiments of the metal element according to the present invention.

In the following description of the preferred emodiments, the same reference numerals are used to indicate members in common with the respective embodiments.

Referring now to FIG. 1, a metal element according to the invention is indicated generally at 1. The metal element includes an upwardly curved portion, indicated generally at 5, which continues into downwardly extending lugs, indicated generally at 7 and 8, the lower portions of which provide anchoring lugs.

The lug 7 provides a substantially vertical surface, and continues upwardly into a convex portion 12, which in turn continues into a concave portion 14, which in turn continues downwardly into a lug 8. Adjacent their lower ends, the lugs 7 and 8 are provided with recesses 33 for the reception of reinforcing rods for a concrete tie, as later explained.

Adjacent the upper ends of the lugs 7 and 8 is a transverse plate 16, which extends between the respective lugs 7 and 8 and is attached thereto in any convenient manner, such as by spot or track welding. The plate 16 substantially perpendicular to the lugs 7 and 8, and extends substantially parallel to the curved portion 5, to define a socket 11 of sufficient dimensions to permit the insertion therein of one leg of a Pandrol clip, again, as is later described.

Figure 5:
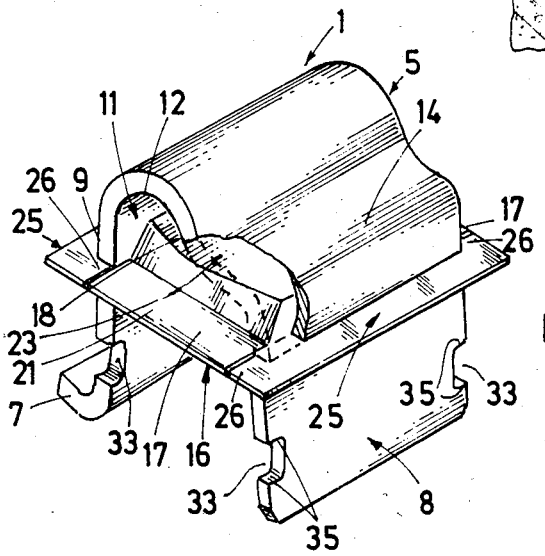

In use of metal element 1, it is inserted in an inverted position into a cavity of a mold employed in the casting of a concrete tie. The plate 16 is so positioned as to provide a closure for the socket 11 in conjunction with the walls of the mold cavity. Reinforcing rods are inserted into the recesses 33, as illustrated in FIG. 5, and an appropriate concrete and aggregate admixture is poured into the mold for it to envelope the then upwardly extending lugs of the metal element 1, the concrete admixture then being permitted to harden with the lugs 7 and 8 and the reinforcing rods 34 embedded within the cast concrete tie.

As will be apparent, in the absence of the transverse plate 16, the concrete admixture would enter and fill the socket 11, this precluding later insertion of a leg of a Pandrol clip.

In order to eliminate this problem, previous teachings have been to insert a filler into the socket 11 to prevent the entry of the concrete admixture into the socket 11. Such fillers are usually press-fit into the socket 11, and are inserted into the socket prior to the positioning of the metal element in the mold cavity. Commonly, such fillers are formed from hollow moldings of plastics material, which are assembled together to provide a hollow cavity.

The prior technique has many disadvantages, each of which is overcome by the metal element of the present invention. In particular, the fillers for the socket 11 must be obtained from a source separate from the manufacturer of the metal elements, with additional complications in warehousing, and, if formed of plastics material, they must be assembled at the production site, with the labor attendant thereon. It is then required the the fillers be press-fitted into the sockets of the relatively heavy metal elements prior to those elements being inserted into the mold cavities. Due to the heavy and unwieldly nature of the metal elements, there is a decided possiblity that the fillers will either be displaced within the socket 11, or, that they will be damaged in the handling of the metal elements prior to insertion of the metal elements into the cavities, or, during the pouring of the concrete admixture, and thus permit the concrete admixture to enter into the socket 11. Further, the fillers must be manually removed from the sockets 11 after casting of the tie, this requiring additional labor in the manufacture of the ties.

These disadvantages are each overcome by the teachings of the present invention in the provision of the transverse plate 16 as an integral part of the metal elements. Additionally, by the provision of the transverse plate 16, the metal elements are themselves reinforced and further strengthened.

FIGS. 2 through 5 illustrate alternative embodiments of the embodiment of FIG. 1.

Figure 2:
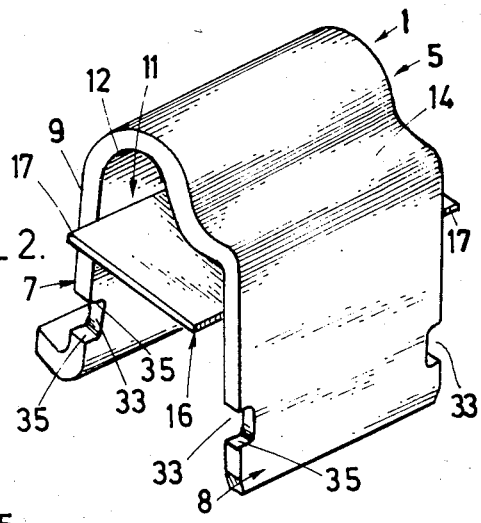

In FIG. 2, the transverse plate 16 is longitudinally elongated at 17 for it to extend beyond the end faces of the metal elements. In this way, it is arranged for the transverse plate to extend over surfaces of the mold adjacent the cavity, and further preclude the entrance of concrete admixture into the socket 11. As in FIG. 1, the recesses 33 are substantially rectangular, for them to provide substantially horizontal upper and lower faces 35 for engagement over the reinforcing rods 34.

Figure 3:
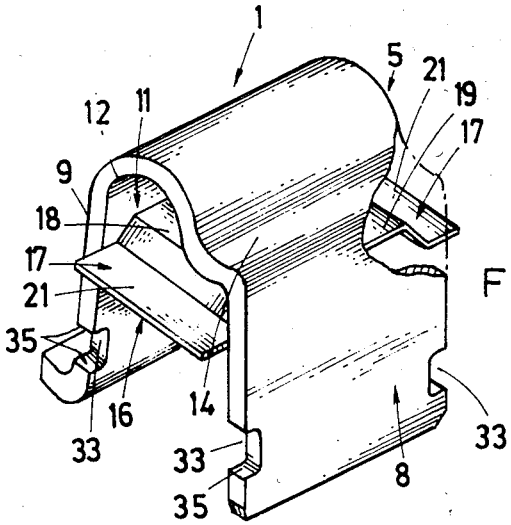

In FIG. 3, the central portion of the transverse plate is displaced upwardly at 18, such that the upper face 19 thereof lies substantially in the plane of a rail base, as later explained, and is positioned above upper faces 21 at the ends 17 of the plate 16. In this manner, a cavity is provided beneath the plate 16, which serves for keying-in of the poured concrete.

Figure 4:
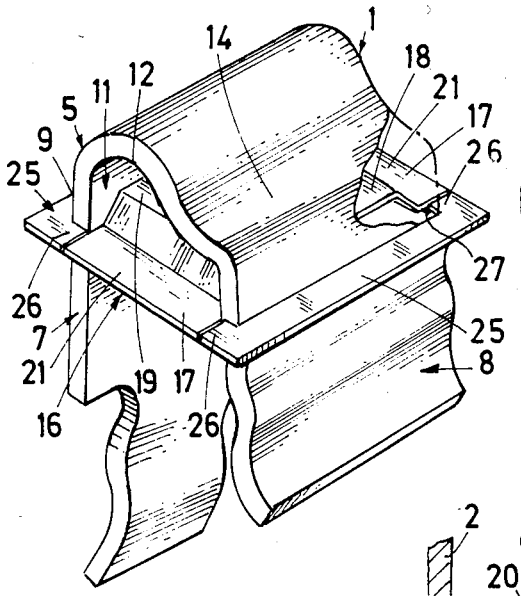

In FIG. 4, two flat metal plates of generally C-shaped plan form extend around the outer sides of the metal element 1, with the center 25 of the plates parallel and perpendicular to lugs 7 and 8, and with the ends 6 thereof transverse and perpendicular to the lugs 7 and 8, and, lying in the plane of the ends 17 of the transverse plate 16. Preferably, the ends 26 are welded to the extending ends 17 of the transverse plate 16. In this way, the entrance of concrete admixture into the mold cavity is further precluded by the barrier extending completely around the periphery of the metal element 1, and, which engages the interior surface of the mold.

In FIG. 5, the central portion 18 of the plate 16 has been made downwardly convex, this permitting an increase in the volume of the cavity beneath the plate 16.

In FIGS. 3, 4 and 5, on pouring of the concrete admixture, not only does the plate 16 provide a barrier against the entrance of the concrete admixture into the socket 11, but in addition, provides for keying of the transverse plate 16 onto the cast concrete tie.

Figure 6:
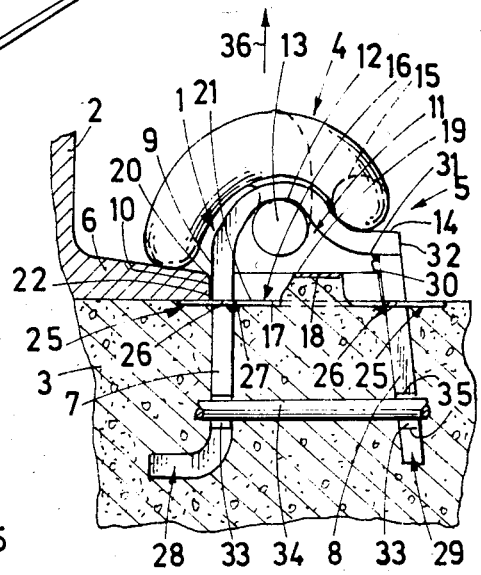
FIG. 6 is a part sectional elevation showing a sixth embodiment of the metal element of the present invention in association with a concrete tie and a rail.

A typical installation of the metal element of FIG. 5 is illustrated in FIG. 6, in which the lugs 7 and 8 locate the reinforcing rods 34, and are embedded in a cast concrete tie 3, the ends 17 of the transverse plate and the center and ends 25, 26 of the C-shaped plates each being positioned with upper faces in the plane of the top face of the concrete tie, and with the center portion 18 keyed to the tie by the in-situ casting of a key on the tie. The lug 7 provides an abuttment 24 the base 6 of the rail 2. The rail is held against movement by a Pandrol clip 4 having one leg 13 received within the socket 11, and another leg 16 overlying the convex portion 14, the nose of the clip engaging the upper surface of the base 6 of the rail.

Various modifications may be made in the lugs 7 and 8. For example, and as shown in FIGS. 4 and 7 through 10, the lugs 7 and 8 can be provided with angled portions to increase their holding power within the cast concrete tie. For example, the lug 7 can include a first portion diverging at 40 in an angle of 20 degrees, a second portion 41 converging in an angle of 20 degrees, and a third portion diverging at 42 in an angle of 30 degrees to provide a tail 39.

The lug 8 can be provided by a plate welded to the concave portion at 31 in an included angle of 95 degrees, and can be provided with a first portion which diverges at 43 in an angle of 20 degrees, a second portion which converges at 44 in an angle of 20 degrees, and a third portion which diverges at 45 in an angle of 30 degrees and terminates in a tail 38. In each instance, convergence or divergence of the lugs 7 and 8 is stated with reference to a central vertical plane lying between the lugs 7 and 8.

Figure 7:
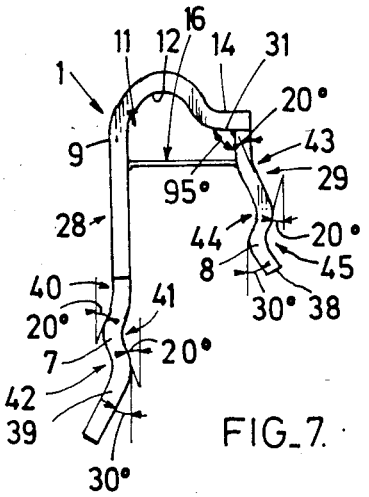
FIG. 7 is an elevation showing a variation of the structure of FIGS. 1 and 2.
Figure 8:
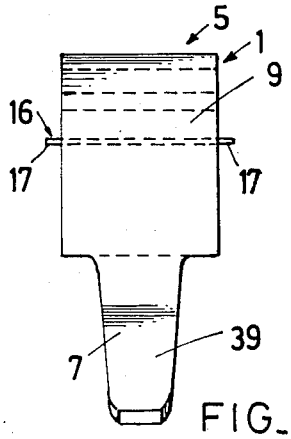
FIG. 8 is a side view corresponding with FIG. 7.
Figure 9:
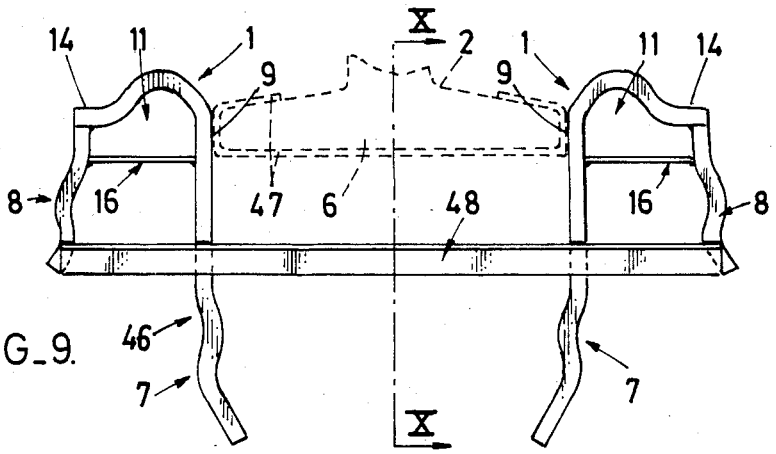
FIG. 9 is an elevation of a double metal element for cooperation with opposite sides of a rail; and, FIG. 10 is a sectional view taken along the line X—X of FIG. 9.
Figure 10:
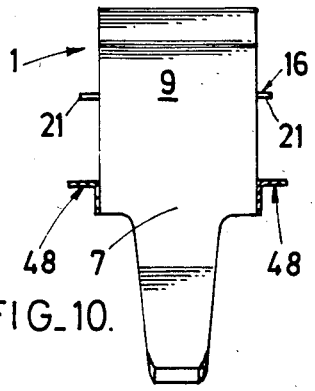

FIGS. 9 and 10 illustrate the manner in which support at both lateral sides of a rail can be provided. In FIGS. 9 and 10, a pair of metal elements as shown in FIGS. 7 and 8 are arranged oppositely to each other to provide a double element, and are interconnected by angle irons 48. Conveniently, the rail 2 is fitted between the respective metal elements with an interpositioning of resilient cushioning material 47.

What is claimed is:

1. In a metal element to be inserted into a mold cavity of a mold employed in the casting of a concrete tie, and for use in securing a rail to said tie, said metal element including an elongate substantially U-shaped member providing a central transversely curved portion for cooperation with a securing clip, and a pair of legs to be secured within said cast concrete tie by the casting of a concrete admixture around said legs, the improvement comprising;

a metal plate extending transversely between said legs and substantially perpendicular thereto;

said metal plate being spaced from said curved portion to define a socket for the reception of a leg of a rail securing clip, and, extending uninteruptedly between axially opposed end faces of said metal element;

said metal plates providing a closure for said mold cavity and being operative to isolate said socket from concrete admixture employed in the casting of a railroad tie.

2. The metal element of claim 1, in which said metal plate extends axially beyond the axially opposed end faces of said metal element, for its ends to overly an interior surface of said mold.

3. The metal element of claim 2, in which said metal plate is formed between its axial ends to provide a recess, said recess providing for the in situ casting of a key on a concrete tie during the casting of said concrete tie.

4. The metal element of claim 2, further including C-shaped metal plates arranged substantially co-planar with said metal plate and extending externally of said legs and secured thereto, said C-shaped metal plates in conjunction with the outwardly extending ends of said metal plate providing a continuous flange extending peripherally of said metal elements, and, further inhibiting the entrance of concrete admixture into said mold cavity and said socket.

5. The metal element of claim 1, including outwardly divergent and inwardly convergent portions of said legs to enhance the securement of said legs within a concrete tie cast around said legs.

6. The metal element of claim 1, including dual said metal elements positioned in opposite spaced relationship for a base of a rail to be positioned between said metal members, and transverse girder members secured to the respective legs of said metal members to maintain said metal members in said opposite spaced relationship.

* * * * *